US009200765B1

(12) United States Patent
Broughton

(10) Patent No.: US 9,200,765 B1
(45) Date of Patent: Dec. 1, 2015

(54) METHOD AND SYSTEM FOR REDIRECTING LIGHT EMITTED FROM A LIGHT EMITTING DIODE

(71) Applicant: Kevin Charles Broughton, Sharpsburg, GA (US)

(72) Inventor: Kevin Charles Broughton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 73 days.

(21) Appl. No.: 14/085,509

(22) Filed: Nov. 20, 2013

Related U.S. Application Data

(60) Provisional application No. 61/728,475, filed on Nov. 20, 2012.

(51) Int. Cl.

| | |
|---|---|
| ***F21V 5/04*** | (2006.01) |
| ***F21K 99/00*** | (2010.01) |
| ***F21V 5/08*** | (2006.01) |
| ***F21V 7/00*** | (2006.01) |

(52) U.S. Cl.
CPC ... *F21K 9/54* (2013.01); *F21V 5/08* (2013.01); *F21V 7/0091* (2013.01)

(58) Field of Classification Search
CPC ..... F21V 5/04; F21V 7/09; F21V 7/0091; F21V 5/08; H01L 33/58
USPC ..... 362/311.02, 310, 329, 308, 431
See application file for complete search history.

(56) References Cited

U.S. PATENT DOCUMENTS

| | | | |
|---|---|---|---|
| 1,758,977 | A | 5/1930 | Rolph |
| 2,254,961 | A | 9/1941 | Harris |
| 2,394,992 | A | 2/1946 | Franck |
| 2,818,500 | A | 12/1957 | Franck |
| 2,908,197 | A | 10/1959 | Wells et al. |
| 3,278,743 | A | 10/1966 | Franck |
| 3,596,136 | A | 7/1971 | Fischer |
| 3,647,148 | A | 3/1972 | Wince |
| 3,927,290 | A | 12/1975 | Denley |
| 4,345,308 | A | 8/1982 | Mouyard et al. |

(Continued)

FOREIGN PATENT DOCUMENTS

| | | |
|---|---|---|
| CN | 2750186 | 1/2006 |
| CN | 1737418 | 2/2006 |

(Continued)

OTHER PUBLICATIONS

Streetworks fixture from Cooper Lighting and 2 IES files, Aug. 14, 2001.

(Continued)

*Primary Examiner* — Peggy Neils
(74) *Attorney, Agent, or Firm* — King & Spalding LLP

(57) ABSTRACT

A light source, for example a light emitting diode, can emit light and have an associated optical axis. The source can be deployed in applications where it is desirable to have illumination biased laterally relative to the optical axis, such as in a street luminaire where directing light towards the street is beneficial. The source can be coupled to an optic that comprises a cavity. A first region of the optic can receive light from the source and emit light towards the area to be illuminated. A second region of the optic can comprise two reflective surfaces. The first reflective surface can receive light from the source and reflect the received light towards the second reflective surface. The two reflective surfaces can be used to direct light away from one side of the optic.

19 Claims, 2 Drawing Sheets

(56) References Cited

U.S. PATENT DOCUMENTS 4,460,945 A 7/1984 Chan
4,729,076 A 3/1988 Masami
4,734,836 A 3/1988 Negishi
4,860,177 A 8/1989 Simms
4,907,044 A 3/1990 Schellhorn et al.
4,941,072 A 7/1990 Yasumoto
5,404,869 A 4/1995 Parkyn
5,424,931 A 6/1995 Wheeler
5,636,057 A 6/1997 Dick et al.
5,782,555 A 7/1998 Hochstein
5,857,767 A 1/1999 Hochstein
5,924,788 A 7/1999 Parkyn, Jr.
5,926,320 A 7/1999 Parkyn
5,939,996 A 8/1999 Kniveton et al.
6,045,240 A 4/2000 Hochstein
6,050,707 A 4/2000 Kondo et al.
6,102,558 A 8/2000 Farnoux
6,227,684 B1 5/2001 Wijbenga
6,227,685 B1 5/2001 McDermott
6,273,596 B1 8/2001 Parkyn, Jr.
6,341,466 B1 1/2002 Kehoe et al.
6,345,800 B1 2/2002 Herst et al.
6,441,558 B1 8/2002 Muthu et al.
6,461,008 B1 10/2002 Pederson
6,502,956 B1 1/2003 Wu
6,527,422 B1 3/2003 Hutchison
6,536,923 B1 3/2003 Merz
6,547,423 B2 4/2003 Marshall et al.
6,560,038 B1 5/2003 Parkyn et al.
6,582,103 B1 6/2003 Popovich et al.
6,598,998 B2 7/2003 West et al.
6,639,733 B2 10/2003 Minano
6,784,357 B1 8/2004 Wang
6,785,053 B2 8/2004 Savage, Jr.
6,837,605 B2 1/2005 Reill
6,850,001 B2 2/2005 Takekuma
6,895,334 B2 5/2005 Yabe
6,942,361 B1 9/2005 Kishimura et al.
6,948,838 B2 9/2005 Kunstler
6,965,715 B2 11/2005 Lei
6,997,580 B2 2/2006 Wong
7,070,310 B2 7/2006 Pond et al.
7,073,931 B2 7/2006 Ishida
7,090,370 B2 8/2006 Clark
7,102,172 B2 9/2006 Lynch et al.
7,104,672 B2 9/2006 Zhang
7,153,015 B2 12/2006 Brukilacchio
7,172,319 B2 2/2007 Holder
7,181,378 B2 2/2007 Benifez
7,204,627 B2 4/2007 Ishida
7,237,936 B1 7/2007 Gibson
7,278,761 B2 10/2007 Kuan
7,281,820 B2 10/2007 Bayat et al.
7,322,718 B2 1/2008 Setomoto et al.
D563,036 S 2/2008 Miyairi et al.
7,329,029 B2 2/2008 Chaves et al.
7,329,030 B1 2/2008 Wang
7,329,033 B2 2/2008 Glovatsky
7,339,200 B2 3/2008 Amano et al.
7,347,599 B2 3/2008 Minano et al.
7,348,604 B2 3/2008 Matheson
7,348,723 B2 3/2008 Yamaguchi et al.
7,352,011 B2 4/2008 Smits et al.
7,374,322 B2 5/2008 Steen et al.
7,410,275 B2 8/2008 Sommers et al.
D577,852 S 9/2008 Miyairi et al.
7,460,985 B2 12/2008 Benitez
7,461,948 B2 12/2008 Van Voorst Vader et al.
7,507,001 B2 3/2009 Kit
7,513,639 B2 4/2009 Wang
7,553,051 B2 6/2009 Brass et al.
7,569,802 B1 8/2009 Mullins
7,572,027 B2 8/2009 Zampini, II
7,572,654 B2 8/2009 Chang
7,575,354 B2 8/2009 Woodward
7,582,913 B2 9/2009 Huang et al.
7,618,162 B1 11/2009 Parkyn et al.
7,618,163 B2 11/2009 Wilcox
7,625,102 B2 12/2009 Koike et al.
7,637,633 B2 12/2009 Wong
7,651,240 B2 1/2010 Bayat et al.
7,674,018 B2 3/2010 Holder et al.
7,775,679 B2 8/2010 Thrailkill et al.
7,777,405 B2 8/2010 Steen et al.
7,809,237 B2 10/2010 Pozdnyakov et al.
7,817,909 B2 10/2010 Montgomery et al.
7,841,750 B2 11/2010 Wilcox et al.
7,854,536 B2 12/2010 Holder
7,942,559 B2 5/2011 Holder
7,972,035 B2 7/2011 Boyer
7,972,036 B1 7/2011 Schach et al.
7,993,036 B2 8/2011 Holder et al.
8,007,140 B2 8/2011 Zhang et al.
8,025,428 B2 9/2011 Duguay et al.
8,210,722 B2 7/2012 Holder et al.
8,382,338 B2 2/2013 Lee
8,414,161 B2 4/2013 Holder et al.
8,469,552 B2 * 6/2013 Moeller ..... 362/311.02
2002/0034081 A1 3/2002 Serizawa
2002/0181222 A1 * 12/2002 Boyd et al. ..... 362/31
2002/0196623 A1 12/2002 Yen
2003/0067787 A1 4/2003 Serizawa
2003/0099115 A1 5/2003 Reill
2004/0004828 A1 1/2004 Chernick
2004/0037076 A1 2/2004 Katoh et al.
2004/0070855 A1 4/2004 Benitez et al.
2004/0105171 A1 6/2004 Minano et al.
2004/0105261 A1 6/2004 Ducharme et al.
2004/0105264 A1 6/2004 Spero
2004/0189933 A1 9/2004 Sun et al.
2004/0207999 A1 10/2004 Suehiro et al.
2004/0218388 A1 11/2004 Suzuki
2004/0222947 A1 11/2004 Newton et al.
2004/0228127 A1 11/2004 Squicciarini
2005/0073849 A1 4/2005 Rhoads et al.
2005/0207165 A1 9/2005 Shimizu et al.
2006/0034082 A1 2/2006 Park
2006/0039143 A1 2/2006 Katoh
2006/0081863 A1 4/2006 Kim et al.
2006/0083003 A1 4/2006 Kim et al.
2006/0138437 A1 6/2006 Huang et al.
2006/0238884 A1 10/2006 Jang
2006/0245083 A1 11/2006 Chou et al.
2006/0250803 A1 11/2006 Chen
2006/0255353 A1 11/2006 Taskar
2006/0285311 A1 12/2006 Chang et al.
2007/0019415 A1 1/2007 Leblanc
2007/0019416 A1 1/2007 Han
2007/0058369 A1 3/2007 Parkyn et al.
2007/0063210 A1 3/2007 Chiu
2007/0066310 A1 3/2007 Haar
2007/0076414 A1 4/2007 Holder
2007/0081338 A1 4/2007 Kuan
2007/0081340 A1 4/2007 Chung et al.
2007/0091615 A1 4/2007 Hsieh et al.
2007/0183736 A1 8/2007 Pozdnyakov
2007/0201225 A1 8/2007 Holder
2007/0258214 A1 11/2007 Shen
2008/0013322 A1 1/2008 Ohkawa
2008/0019129 A1 1/2008 Wang
2008/0025044 A1 1/2008 Park et al.
2008/0043473 A1 2/2008 Matsui
2008/0055908 A1 3/2008 Wu
2008/0068799 A1 3/2008 Chan
2008/0080188 A1 4/2008 Wang
2008/0100773 A1 5/2008 Hwang
2008/0174996 A1 7/2008 Lu
2008/0239722 A1 10/2008 Wilcox
2008/0273327 A1 11/2008 Wilcox et al.
2009/0244895 A1 10/2009 Chen
2009/0262543 A1 10/2009 Ho
2010/0014290 A1 1/2010 Wilcox

(56) References Cited

U.S. PATENT DOCUMENTS

| | | | | |
|---|---|---|---|---|
| 2010/0296283 | A1* | 11/2010 | Taskar et al. | 362/235 |
| 2012/0044699 | A1* | 2/2012 | Anderson | 362/307 |
| 2014/0016326 | A1* | 1/2014 | Dieker et al. | 362/308 |

FOREIGN PATENT DOCUMENTS

| | | |
|---|---|---|
| DE | 202006015981 | 1/2007 |
| EP | 1431653 | 6/2004 |
| EP | 1686630 | 8/2006 |
| GB | 718425 | 11/1954 |
| GB | 794670 | 5/1958 |
| GB | 815609 | 7/1959 |
| JP | 06-177424 | 6/1994 |
| JP | 11-154766 | 9/1997 |
| JP | 2001-517855 | 9/1998 |
| JP | 2005-062461 | 3/2005 |
| JP | 2009-021086 | 1/2009 |
| KR | 10-2006-0033572 | 4/2006 |
| KR | 10-2006-0071033 | 6/2006 |
| KR | 20070015738 | 2/2007 |
| KR | 20100015957 | 2/2010 |
| KR | 20100105388 | 9/2010 |
| WO | WO 96/24802 | 8/1996 |
| WO | WO 98/33007 | 7/1998 |
| WO | WO 03/044870 | 5/2003 |
| WO | WO 2004/068909 | 8/2004 |
| WO | WO 2005/041254 | 5/2005 |
| WO | WO 2005/057082 | 6/2005 |
| WO | WO 2005/093316 | 10/2005 |
| WO | WO 2007/100837 | 9/2007 |
| WO | WO 2008/144672 | 11/2008 |
| WO | WO 2010/019810 | 2/2010 |
| WO | WO 2011/098515 | 8/2011 |

OTHER PUBLICATIONS

Bisberg, *LED Magazine*, The 5mm. Package Versus the Power LED: Not a Light choice for the Luminaire Designer, pp. 19-21, Dec. 2005. *LED Magazine*, p. 36 Oct. 2005.

International Search Report and Written Opinion for WO 2010-019810 mailed Sep. 30, 2009.

ISR and Written Opinion of ISA, PCT-US07-05118 mailed Mar. 11, 2008.

Bortz, "Optimal Design of a Non imaging Projection Lens for Use with an LED Light Source and a Rectangular Sheet." SPIE, pp. 130-138, vol. 4092, USA, published 2000.

International Search Report for PCT-US08-64168 mailed on Aug. 15, 2008.

Extended Search Report for EP Application No. 11006191 mailed Nov. 7, 2011.

Extended Search Report for EP Application No. 11006189 mailed Nov. 7, 2011.

Extended Search Report for EP Application No. 11006190 mailed Nov. 7, 2011.

Timinger, Dr. Andreas, *High Performance Optics Design for LEDs*, Strategies in Light, Feb. 2005.

Ries, Harold & Julius Muschaweck, *Tailored Freeform Optical Surfaces*, Optical Society of America, vol. 19, No. 3, Mar. 2002.

Extended Search Report for EP Application No. 08755907.6 mailed May 10, 2012.

Jolley L.B.W. et al., The Therory and Design of Illuminating Engineering Equipment, 1931.

Order; Case No. 11-CV-34-JPS; United States District Court Eastern District of Wisconsin; Jun. 8, 2012; (referencing U.S. Patent Nos. 7,674,018 and 7,993,036).

International Search Report for PCT-US11-049388 mailed on Apr. 9, 2012.

Timinger, Andreas, Strategies Unlimited, "Charting New Directions in High-Brightness LED's ," Strategies in Light, Feb. 5-7, 2003.

Timinger, Andreas, "Optical Design for LED-Street Lamps," Conference Paper, Solid-State and Organic Lighting (SOLED), Karlsruhe, Germany, Jun. 21, 2010.

Order, Case No. 11-CV-34-JPS; United States District Court Eastern District of Wisconsin; filed Oct. 31, 2012.

LED's Magazine; High-Power LED's; Multi-watt LED light Engines Offer Challenges and Opportunities; ledmagazine.com Oct. 2005.

Timinger, "Tailored Optical Surfaces Step up Illumination Design," Europhonics; Aug.-Sep. 2002 (color copy).

Plantiff Illumination Management Solutions, Inc.'s Initial Claim Construction Brief; Case No. 2:11-CV-00034 JPS; Apr. 5, 2012.

Ruud Lighting's Notice Pursuant to 35 U.S.C. §282; Civil Action 2:11-CV-00034-JPS; Oct. 12, 2012.

Expert Report of Dr. Roland Winston Regarding Invalidity, Civil Action 2:11-CV-00034-JPS; Jul. 17, 2012; Exhibits A-C.

Expert Report of Dr. Rick Mistrick; Validity of the '018 and '036 Patents; Civil Action 2:11-CV-00034-JPS; Aug. 17, 2012.

Expert Report of Dr. Rick Mistrick; Rebuttal of Dr. Roland Winston; Civil Action 2:11-CV-00034-JPS; Aug. 17, 2012.

Aoyama, Y.; Yachi, T., "An LED Module Array System Designed for Streetlight Use," Energy 2030 Conference, 2008. ENERGY 2008. IEEE , vol., no., pp. 1-5, Nov. 17-18, 2008, doi: 10.1109/Energy.2008.4780996; URL: http://ieeexplore.ieee.org/stamp/stamp.jsp?tp=&arnumber=4780996&isnumber=4780986.

Petroski, J.; Norley, J.; Schober, J.; Reis, B.; Reynolds, R.A.; , "Conduction cooling of large LED array systems," Thermal and Thermomechanical Phenomena in Electronic Systems (ITherm), 2010 12th IEEE Intersociety Conference on , vol., no., pp. 1-10, Jun. 2-5, 2010; doi: 10.1109/ITHERM.2010.5501350; URL: http://ieeexplore.ieee.org/stamp/stamp.jsp?tp=&arnumber=5501350&isnumber=5501251.

Wankhede, M.; Khaire, V.; Goswami, A.; Mahajan, S.D.; , "Evaluation of Cooling Solutions for Out-door Electronics," Electronics Packaging Technology Conference, 2007. EPTC 2007. 9th, vol., no., pp. 858-863, Dec. 10-12, 2007; doi: 10.1109/EPTC.2007.4469682; URL: http://ieeexplore.ieee.org/stamp/stamp.jsp?tp=&arnumber=4469682&isnumber=4469670.

International Search Report for PCT/US2012/026971; mailed Sep. 27, 2012.

European Search Report for application No. 09807313.3, mailed Sep. 25, 2014.

* cited by examiner

METHOD AND SYSTEM FOR REDIRECTING LIGHT EMITTED FROM A LIGHT EMITTING DIODE

RELATED APPLICATIONS

The present application claims priority under 35 U.S.C. Section 119 to U.S. Provisional Application No. 61/728,475, filed on Nov. 20, 2012, and titled "Method and System For Redirecting Light Emitted From a Light Emitting Diode." The foregoing application is incorporated herein in its entirety.

The present application is related to U.S. Non-Provisional application Ser. No. 13/828,670, filed on Mar. 14, 2013, and titled "Method and System For Managing Light From a Light Emitting Diode," which is a continuation-in-part of and claims priority to U.S. Non-Provisional application Ser. No. 13/407,401, filed on Feb. 28, 2012, and titled "Method and System for Managing Light from a Light Emitting Diode." The foregoing applications are incorporated herein in their entirety.

FIELD OF THE TECHNOLOGY

The present technology relates to managing light emitted by one or more light emitting diodes ("LEDs"), and more specifically to optical elements that can apply successive reflections of the emitted light to redirect the light in a desired direction.

BACKGROUND OF THE INVENTION

Light emitting diodes are useful for indoor and outdoor illumination, as well as other applications. Many such applications would benefit from an improved technology for managing light produced by a light emitting diode, such as forming an illumination pattern matched or tailored to application parameters.

For example, consider lighting a street running along a row of houses, with a sidewalk between the houses and the street. Conventional, unbiased light emitting diodes could be mounted over the sidewalk, facing down, so that the optical axis of an individual light emitting diode points towards the ground. In this configuration, the unbiased light emitting diode would cast substantially equal amounts of light towards the street and towards the houses. The light emitted from each side of the optical axis continues, whether headed towards the street or the houses. However, most such street lighting applications would benefit from biasing the amount of light illuminating the street relative to the amount of light illuminating the houses. Many street luminaires would thus benefit from a capability to transform house side light into street side light.

In view of the foregoing discussion of representative shortcomings in the art, need for improved light management is apparent. Need exists for a compact apparatus to manage light emitted by a light emitting diode. Need further exists for an economical apparatus to manage light emitted by a light emitting diode. Need further exists for a technology that can efficiently manage light emitted by a light emitting diode, resulting in energy conservation. Need further exists for an optical device that can transform light emanating from a light emitting diode into a desired pattern, for example aggressively redirecting one or more selected sections of the emanating light. Need further exists for technology that can directionally bias light emitted by a light emitting diode. Need exists for improved lighting, including street luminaires, outdoor lighting, and general illumination. A capability addressing such need, or some other related deficiency in the art, would support cost effective deployment of light emitting diodes in lighting and other applications.

SUMMARY OF THE INVENTION

An apparatus can process light emitted by one or more light emitting diodes to form a desired illumination pattern, for example successively applying at least two total internal reflections to light headed in certain directions, resulting in beneficial redirection of that light.

In one aspect of the present technology, a light emitting diode can produce light and have an associated optical axis. A body of optical material can be oriented with respect to the light emitting diode to process the produced light. The body can be either seamless or formed from multiple elements joined or bonded together, for example. A first section of the produced light can transmit through the body of optical material, for example towards an area to be illuminated. The body of optical material can redirect a second section of the produced light, for example so that light headed in a non-strategic direction is redirected towards the area to be illuminated. A refractive surface on an interior side of the body of optical material can form a beam from the second section of the produced light or otherwise reduce divergence of that light. The beam can propagate in the optical material at an angle relative to the optical axis of the light emitting diode while heading towards a first reflective surface on an exterior side of the body of optical material. Upon beam incidence, the first reflective surface can redirect the beam to a second reflective surface on an exterior side of the body of optical material. The second reflective surface can redirect the beam across the optical axis outside the body and towards the area to be illuminated. Accordingly, the first and second reflective surfaces can collaboratively redirect light from a non-strategic direction to a strategic direction. One or both of the reflective surfaces can be reflective as a result of comprising an interface between a transparent optical material having a relatively high refractive index and an optical medium having relatively low refractive index, such as a totally internally reflective interface between optical plastic and air. Alternatively, one or both of the reflective surfaces can comprise a coating that is reflective, such as a sputtered aluminum coating applied to a region of the body of optical material.

The foregoing discussion of managing light is for illustrative purposes only. Various aspects of the present technology may be more clearly understood and appreciated from a review of the following detailed description of the disclosed embodiments and by reference to the drawings and the claims that follow. Moreover, other aspects, systems, methods, features, advantages, and objects of the present technology will become apparent to one with skill in the art upon examination of the following drawings and detailed description. It is intended that all such aspects, systems, methods, features, advantages, and objects are to be included within this description, are to be within the scope of the present technology, and are to be protected by the accompanying claims.

Figure 1:
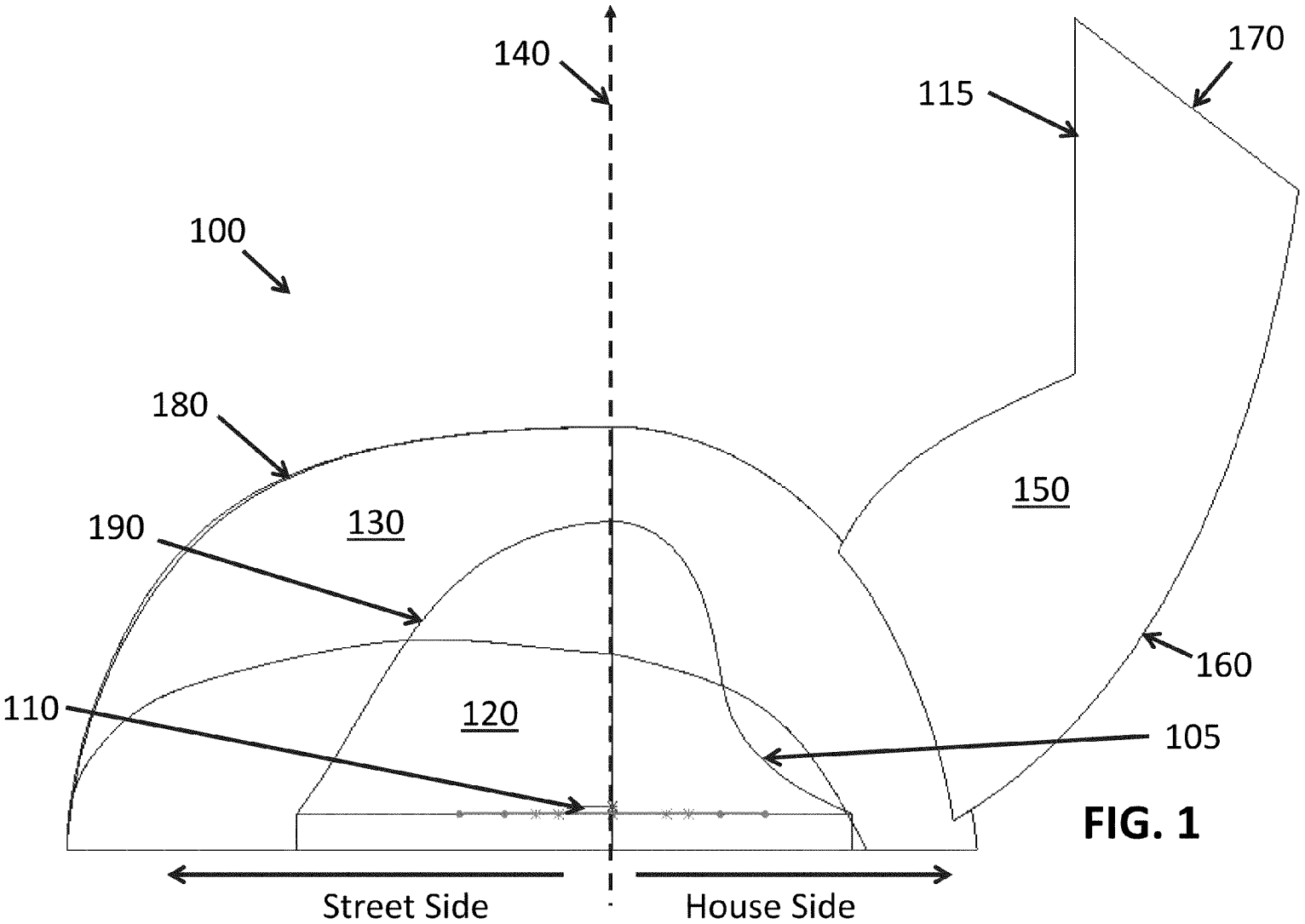
FIG. 1 is an illustration of an illumination system comprising a light emitting diode and an optic that manages light emitted by the light emitting diode according to certain exemplary embodiments of the present technology.

Many aspects of the technology can be better understood with reference to the above drawings. The elements and features shown in the drawings are not to scale, emphasis instead being placed upon clearly illustrating the principles of exemplary embodiments of the present technology. Moreover, certain dimensions may be exaggerated to help visually convey such principles. In the drawings, reference numerals designate like or corresponding, but not necessarily identical, elements throughout the several views.

DESCRIPTION OF EXAMPLE EMBODIMENTS OF THE INVENTION

A light source can emit light. In certain embodiments, the light source can be or comprise one or more light emitting diodes, for example. The light source and/or the emitted light can have an associated optical axis. The light source can be deployed in applications where it is desirable to bias illumination laterally relative to the optical axis. For example, in a street luminaire where the optical axis is pointed down towards the ground, it may be beneficial to direct light towards the street side of the optical axis, rather than towards a row of houses that are beside the street. The light source can be coupled to an optic that receives light propagating on one side of the optical axis and redirects that light across the optical axis. For example, the optic can receive light that is headed towards the houses and redirect that light towards the street.

The optic can comprise an inner surface facing the light source and an outer surface facing away from the light source, opposite the inner surface. The inner surface can form a cavity that receives light emitted by the light source. The outer surface can comprise a protrusion or projection that reflects light at least two times and that redirects light across the optical axis. Accordingly, the optic can transform light headed in a non-strategic direction to light headed a strategic direction.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 2:
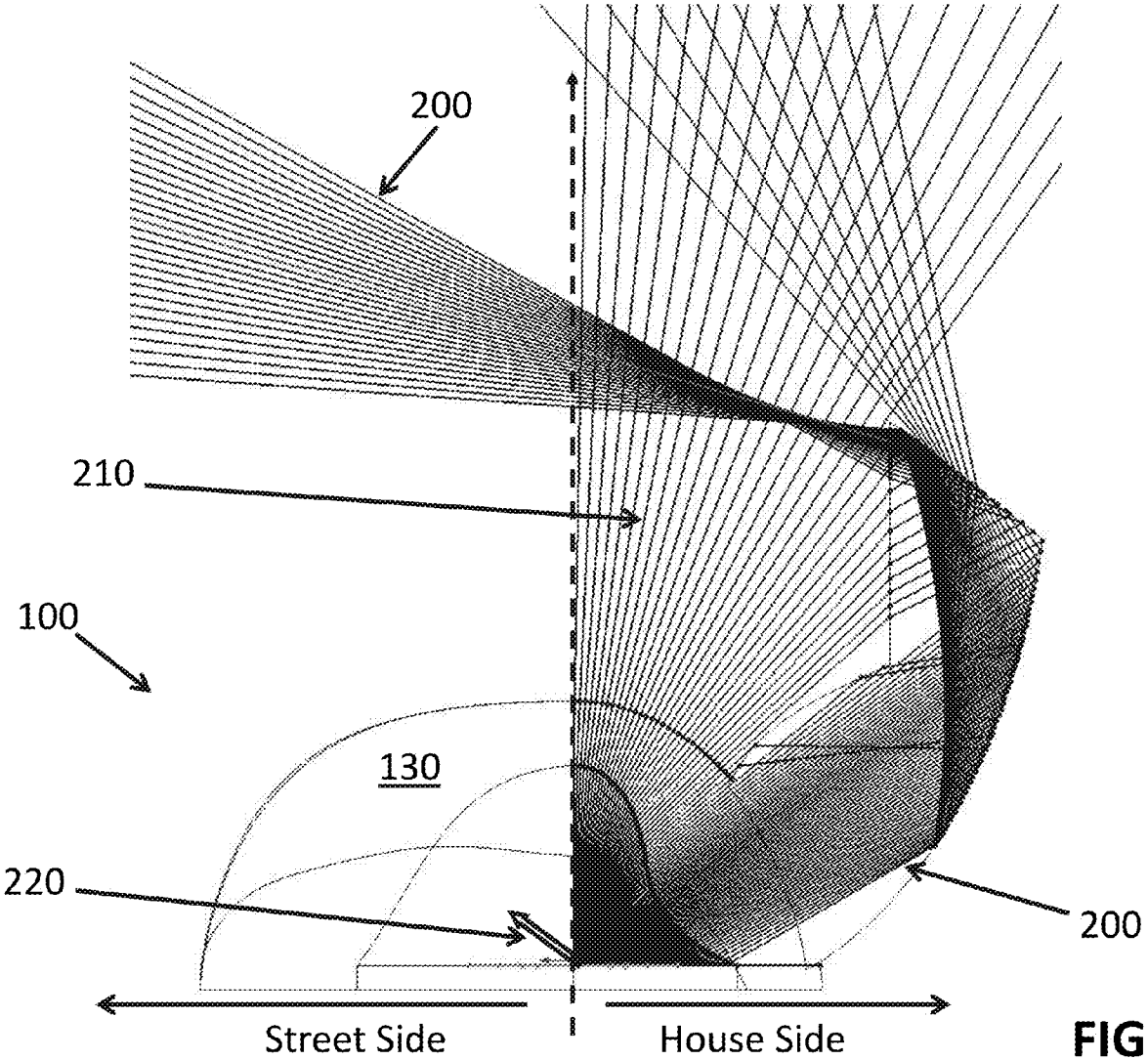
FIG. 2 is another illustration of the illumination system that FIG. 1 illustrates, with overlaid ray tracing according to certain exemplary embodiments of the present technology.

Turning now to FIGS. 1 and 2, these figures illustrate, in cross section, an exemplary illumination system 100 comprising a representative light emitting diode 110 and a representative optic 130 that manages light emitted by the light emitting diode 110 in accordance with certain embodiments of the present technology. FIG. 2 includes representative ray traces.

In certain embodiments, the illumination system 100 can be or comprise a luminaire for street illumination. However, those of ordinary skill having benefit of this disclosure will appreciate that street illumination is but one of many applications that the present technology supports. The present technology can be applied in numerous lighting systems and illumination applications, including indoor and outdoor lighting, automobiles, general transportation lighting, and portable lights, to mention a few representative examples without limitation.

The light emitting diode 110 produces light 200, 210 that is headed house side, opposite from street side, and other light 220 that is headed street side. The optic 130 can redirect a substantial portion of the house side light 200, 210 towards the street, where higher illumination intensity is often desired.

The light emitting diode 110 can be solitary or part of a light emitting diode array that is mounted adjacent (i.e., underneath) the optic 130. In certain embodiments, the light emitting diode 110 may comprise an encapsulant that provides environmental protection to the light emitting diode's semiconductor materials and that emits the light that the light emitting diode 110 generates. In certain example embodiments, the encapsulant comprises material that encapsulates the light generating optical element of the light emitting diode 110, for example an optoelectronic semiconductor structure or feature on a substrate of the light emitting diode 110. In certain example embodiments of the invention, the light emitting diode 110 can project or protrude into a cavity 120 that the interior surface 190 of the optic 130 forms. In certain example embodiments, the light emitting diode 110 radiates light at highly diverse angles, for example providing a light distribution pattern that can be characterized, modeled, or approximated as Lambertian.

The illustrated light emitting diode 110 comprises an optical axis 140 associated with the pattern of light emitting from the light emitting diode 110 and/or associated with physical structure or mechanical features of the light emitting diode 110. The term "optical axis," as used herein, generally refers to a reference line along which there is some degree of rotational or other symmetry in an optical system, or a reference line defining a path along which light propagates through a system. Such reference lines are often imaginary or intangible lines.

The cavity 120 comprises an inner surface 190 opposite an outer surface 180. Light 220 emitted from the light emitting diode 110 in the street side direction is incident upon the inner surface 190, passes through the optic 130, and passes through the outer surface 180. Such light 220 may be characterized by a solid angle or represented as a ray or a bundle of rays. Accordingly, the light 220 that is emitted from the light emitting diode 110 and headed street side continues heading street side after interacting with the optic 130. The inner surface 190 and the outer surface 180 cooperatively manipulate this light 220 with sequential refraction to produce a selected pattern, for example concentrating the light 220 downward or outward depending upon desired level of beam spread. In the illustrated embodiment, the light 220 sequentially encounters and is processed by two refractive interfaces of the optic 130, first as the light enters the optic 130, and second as the light exits the optic 130.

The light emitting diode 110 further emits a section of light 200 that is headed house side or away from the street. This section of light 200 is incident upon a convex surface 105 of the cavity 120 that forms a beam 200 within the optic 130. In the illustrated embodiment, the convex surface 105 projects, protrudes, or bulges into the cavity 120, which is typically filled with a gas such as air. In certain exemplary embodiments, the convex surface 105 can be characterized as a collimating lens or as a refractive feature that reduces light divergence. The term "collimating," as used herein in the context of a lens or other optic, generally refers to a property of causing light to become more parallel that the light would otherwise be in the absence of the collimating lens or optic. Accordingly, a collimating lens may provide a degree of focusing.

The beam 200 propagates or travels through the optic 130 and into a projection 150 on the exterior surface 180 of the optic 130. The projection comprises two internally reflective surfaces 160, 170 that successively reflect the light 200, resulting in redirection across the optical axis 140 outside the optic 130. The redirected light 200 exits the optic 130 through the surface 115 headed in the street side direction. In various example embodiments, the surfaces 160, 170, and 115 may be flat or curved or a combination of flat and curved. For example, as shown in FIG. 1, surface 160 is curved while surface 170 is flat.

The reflective surfaces 170 and 160 are typically totally internally reflective as a result of the angle of light incidence exceeding the "critical angle" for total internal reflection. The reflective surfaces 170 and 160 are typically interfaces between solid, transparent optical material of the optic 130 and a surrounding gaseous medium such as air.

Those of ordinary skill in the art having benefit of this disclosure will appreciate that the term "critical angle," as used herein, generally refers to a parameter for an optical system describing the angle of light incidence above which total internal reflection occurs. The terms "critical angle" and "total internal reflection," as used herein, are believed to conform with terminology commonly recognized in the optics field.

The light emitting diode 110 further emits a section of light 210 that is headed house side less aggressively than the section of light 200, in other words more vertically. The optic 130 transmits that light 210 so that a controlled level of light is emitted towards the house side.

In certain exemplary embodiments, the optic 130 is a unitary optical element that comprises molded plastic material that is transparent. In certain exemplary embodiments, the optic 130 is a seamless unitary optical element. In certain exemplary embodiments, the optic 130 is formed of multiple transparent optical elements bonded, fused, glued, or otherwise joined together to form a unitary optical element that is void of air gaps yet made of multiple elements.

In certain exemplary embodiments, the optic 130 can be formed of an optical plastic such as poly-methyl-methacrylate ("PMMA"), polycarbonate, or an appropriate acrylic, to mention a few representative material options without limitation. In certain exemplary embodiments, the optic 130 can be formed of optical grade silicone and may be pliable and/or elastic, for example.

Technology for managing light emitted from a light emitting diode or other source has been described. From the description, it will be appreciated that an embodiment of the present technology overcomes the limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art. Therefore, the scope of the present technology is to be limited only by the claims that follow.

What is claimed is:

1. An illumination system comprising:

at least one light emitting diode (LED) light source having an optical axis extending substantially perpendicular to the at least one LED light source; and an optic that is intersected by the optical axis to provide a house side and a street side, the optic comprising:

an interior surface defining a cavity that is oriented to receive light emitted by the at least one LED light source, the interior surface comprising a convex surface that is located on the house side of the optic, that protrudes into the cavity, that forms a collimating lens, and that is positioned to receive and collimate a portion of light emitted house side by the LED light source, wherein the cavity comprises a street side and a house side, with the street side of the cavity larger than the house side of the cavity; and an exterior surface opposite the interior surface, the exterior surface comprising:

a first region through which the optical axis passes;

a second region that is offset from the first region, that is disposed on the house side of the optic, and that comprises a projection, wherein the projection comprises:

a first totally internally reflective surface that is oriented away from the optical axis, that is oriented to receive light from the collimating lens, and that curves upward;

a second totally internally reflective surface that is substantially flat, that is oriented away from the optical axis, and that adjoins the first totally internally reflective surface;

a vertical surface that is oriented towards the optical axis and that comprises an upper portion and a lower portion, the upper portion of the vertical surface adjoining the second totally internally reflective surface; and a curved surface that is oriented towards the optical axis and that extends from the lower portion of the vertical surface towards the first region of the exterior surface, wherein the first totally internally reflective surface is oriented to transfer light to the second totally internally reflective surface, and wherein the second totally internally reflective surface is oriented to reflect the transferred light through the upper portion of the vertical surface and across the optical axis.

2. The illumination system of claim 1, wherein the first region of the exterior surface is disposed a first distance from the light emitting diode, wherein the second totally internally reflective surface is disposed a second distance from the light emitting diode, and wherein the second distance is substantially greater than the first distance.

3. The illumination system of claim 1, wherein the interior surface of the optic is asymmetric with respect to the optical axis of the LED light source.

4. The illumination system of claim 1, wherein the illumination system comprises an array of LEDs, the array comprising said at least one LED light source.

5. The illumination system of claim 1, wherein the collimating lens is operative to reduce divergence of light emitted by the light emitting diode.

6. The illumination system of claim 1, wherein the second totally internally reflective surface is oriented to reflect the transferred light across a portion of the optical axis that is outside the optic.

7. A method comprising the steps:

emitting light from a light emitting diode into a cavity of an optic that comprises a street side and a house side, wherein the street side of the optic is disposed on a first side of an optical axis of the light emitting diode, wherein the house side of the optic is disposed on a second side of the optical axis, and wherein the house side of the optic comprises a projection comprising two internally reflective surfaces;

transmitting through the optic a first portion of the emitted light that is incident on the street side of the optic; and with the two internally reflective surfaces, successively reflecting a second portion of the emitted light that is incident on the house side of the optic, wherein the projection comprises a first section and a second section, wherein the first section is disposed between the second section and the light emitting diode and comprises a first of the two internally reflective surfaces, wherein the first section tapers in cross section with increasing distance from the light emitting diode, wherein the second section expands in cross section with increasing distance from the light emitting diode, and wherein the second section comprises:

a first surface area that is oriented towards the optical axis and that extends substantially parallel to the optical axis; and a second surface area that comprises a second of the two internally reflective surfaces and that adjoins the first surface area.

8. The method of claim 7, wherein the two internally reflective surfaces comprise a first totally internally reflective surface and a second totally internally reflective surface, and wherein the step of successively reflecting the second portion of the emitted light comprises:

the first totally internally reflective surface receiving the second portion of the emitted light and reflecting the second portion of the emitted light towards the second totally internally reflective surface; and the second totally internally reflective surface receiving the second portion of the emitted light from the first totally internally reflective surface and reflecting the second portion of the emitted light.

9. The method of claim 8, wherein the second totally internally reflective surface reflects the second portion of the emitted light in a street side direction.

10. The method of claim 7, wherein successively reflecting the second portion of the emitted light that is incident on the house side of the optic comprises redirecting the second portion of the emitted light house side.

11. The method of claim 7, wherein the step of emitting light from the light emitting diode comprises emitting light from a plurality of light emitting diodes.

12. The method of claim 7, wherein the step of emitting light from the light emitting diode into the cavity of the optic includes directing the light from the light emitting diode at an interior surface of the optic, wherein the interior surface comprises a convex surface that forms a collimating lens on the house side of the optic.

13. An optic comprising:

an interior surface defining a cavity that is oriented to receive light emitted by a light emitting diode; and an exterior surface opposite the interior surface, the exterior surface comprising a projection located off a central axis of the optic, wherein the projection comprises a first totally internally reflective (TIR) surface that is oriented to transfer light to a second TIR surface, wherein the second TIR surface transfers light across the central axis of the optic, wherein the projection comprises a first extending portion and a second extending portion, wherein the first extending portion is disposed between the second extending portion and the cavity, wherein in a cross section, the first extending portion tapers with increasing distance from the cavity, and wherein in the cross section, the second extending portion expands with increasing distance from the cavity.

14. The optic of claim 13, wherein the second TIR surface reflects light outside the optic from one side of the optic to the other.

15. The optic of claim 13, wherein the first TIR surface is oriented to reflect a portion of light emitted by an LED across a portion of the optical axis that is outside the optic.

16. The optic of claim 13, wherein the second TIR surface comprises a flat region, and wherein the first TIR surface comprises a curved region.

17. The optic of claim 13, wherein the interior surface comprises a convex portion and a concave portion.

18. The optic of claim 13, wherein the interior surface of the optic comprises a collimating lens adjacent the projection.

19. The optic of claim 13, wherein the interior surface comprises a convex surface.

* * * * *